US011034425B2

(12) United States Patent
Tamura et al.

(10) Patent No.: US 11,034,425 B2
(45) Date of Patent: Jun. 15, 2021

(54) SHIP CONTROL

(71) Applicant: Yanmar Co., Ltd., Osaka (JP)

(72) Inventors: Gakuji Tamura, Osaka (JP); Ryosuke Ohashi, Osaka (JP)

(73) Assignee: YANMAR POWER TECHNOLOGY CO., LTD., Osaka (JP)

( * ) Notice: Subject to any disclaimer, the term of this patent is extended or adjusted under 35 U.S.C. 154(b) by 172 days.

(21) Appl. No.: 16/088,030

(22) PCT Filed: Mar. 24, 2017

(86) PCT No.: PCT/JP2017/012117
§ 371 (c)(1),
(2) Date: Sep. 24, 2018

(87) PCT Pub. No.: WO2017/164392
PCT Pub. Date: Sep. 28, 2017

(65) Prior Publication Data

US 2019/0112020 A1 Apr. 18, 2019

(30) Foreign Application Priority Data

Mar. 25, 2016 (JP) ..... JP2016-062859

(51) Int. Cl.
*B63H 21/21* (2006.01)
*B63H 25/42* (2006.01)
*B63H 20/00* (2006.01)

(52) U.S. Cl.
CPC ..... *B63H 21/21* (2013.01); *B63H 21/213* (2013.01); *B63H 25/42* (2013.01); *B63H 2020/003* (2013.01); *B63H 2021/216* (2013.01)

(58) Field of Classification Search
CPC ..... B63H 21/21; B63H 21/213; B63H 25/42; B63H 2020/003; B63H 2021/216
See application file for complete search history.

(56) References Cited

U.S. PATENT DOCUMENTS 7,131,385 B1 * 11/2006 Ehlers ..... B63H 25/42 114/145 R
2006/0052014 A1 * 3/2006 Kobayashi ..... B63H 20/00 440/53

(Continued)

FOREIGN PATENT DOCUMENTS

CN 103085618 A 5/2013
EP 3222511 A1 9/2017

(Continued)

OTHER PUBLICATIONS

European Search Report dated Feb. 5, 2019 issued in corresponding EP Application 17770432.7 cites the patent documents above.

(Continued)

*Primary Examiner* — Hunter B Lonsberry
*Assistant Examiner* — Elizabeth Yang
(74) *Attorney, Agent, or Firm* — Norton Rose Fulbright US LLP

(57) ABSTRACT

A ship includes an out-drive unit that exerts a propulsion force on a ship hull by power from an engine; a detection device for detecting a current position, a bow direction, and a moving speed of the ship hull; a brake pedal that limits a moving speed of the ship hull; a brake sensor that detects a foot-pushing amount on the brake pedal; and a ship steering control device connected to the out-drive unit, the detection means, and the brake sensor. The ship steering control device acquires an operating status of the out-drive unit and detection results obtained by the detection device and the brake sensor, and controls the out-drive unit based on the detection results. The ship steering control device changes the output of the out-drive unit in accordance with a foot-pushing amount on the brake pedal.

18 Claims, 7 Drawing Sheets

(56) References Cited

U.S. PATENT DOCUMENTS

| | | | | |
|---|---|---|---|---|
| 2008/0269968 | A1* | 10/2008 | Stewart | B63H 20/12 701/21 |
| 2009/0156068 | A1* | 6/2009 | Barrett | B60W 10/08 440/3 |
| 2011/0183554 | A1* | 7/2011 | Daum | B63H 25/42 440/1 |
| 2014/0067225 | A1* | 3/2014 | Lee | B60W 30/188 701/93 |
| 2015/0239541 | A1 | 8/2015 | Anma | |
| 2015/0349581 | A1 | 12/2015 | Tochigi et al. | |
| 2017/0240254 | A1* | 8/2017 | Cho | B63H 21/21 |
| 2019/0359300 | A1* | 11/2019 | Johnson | B63B 49/00 |

FOREIGN PATENT DOCUMENTS

| | | | |
|---|---|---|---|
| JP | H01-233198 | A | 9/1989 |
| JP | 2006-076406 | A | 3/2006 |
| JP | 2014-046864 | A | 3/2014 |
| JP | 2014-137039 | A | 7/2014 |
| JP | 2014-184846 | A | 10/2014 |
| WO | 2014/087450 | A1 | 6/2014 |

OTHER PUBLICATIONS

Office Action dated Oct. 23, 2018 to corresponding Japanese Patent Application No. 2016/062859, citing patent reference listed above.
International Search Report dated May 30, 2017 issued in corresponding PCT Application PCT/JP2017/012117 cites the patent documents above.

* cited by examiner

SHIP CONTROL

CROSS REFERENCES TO RELATED APPLICATIONS

This application is a national stage application pursuant to 35 U.S.C. § 371 of International Application No. PCT/JP2017/012117, filed on Mar. 24, 2017, which claims priority under 35 U.S.C. § 119 to Japanese Patent Application No. 2016-062859, filed on Mar. 25, 2016, the disclosures of which are hereby incorporated by reference in their entireties.

TECHNICAL FIELD

The present invention relates to a ship, and particularly to a technique enabling a ship to be manipulated as if it was a vehicle.

BACKGROUND ART

Conventional ships have no concept of braking, and for example, a technique shown in Patent Literature 1 (PTL 1) adopts a method in which an accelerator lever is manipulated into a reverse traveling position to apply a propulsion force in a reverse direction or a method in which the accelerator lever is manipulated into a neutral position to make a propulsion force zero so that a ship decelerates or stops by inertia. In other words, in the conventional ships, the magnitude or the output direction of a propulsion force of a propulsion unit is changed by manipulating the accelerator lever, to limit a ship navigation speed.

CITATION LIST

Patent Literature

PTL 1: Japanese Patent Application Laid-Open No. 2014-46864

SUMMARY OF INVENTION

Technical Problem

A ship steering operation is unique, and largely differs in many points from a method for manipulating a land vehicle. It therefore takes time for a beginner to be skilled in the ship steering operation. In view of these circumstances, an object of the present invention is to provide a technique enabling a ship to be manipulated as if it was a vehicle.

Solution to Problem

A ship according to an aspect of the present invention includes: a propulsion unit that exerts a propulsion force on a ship hull by power from an engine; detection means for detecting a current position, a bow direction, and a moving speed of the ship hull; a brake pedal that limits a moving speed of the ship hull; a brake sensor that detects a foot-pushing amount on the brake pedal; and a control device that is connected to the propulsion unit, the detection means, and the brake sensor, the control device being configured to acquire an operating status of the propulsion unit and detection results obtained by the detection means and the brake sensor, and to control the propulsion unit based on the detection results, the control device being configured to change an output of the propulsion unit in accordance with a foot-pushing amount on the brake pedal detected by the brake sensor.

The control device may perform a dynamic positioning control upon the brake sensor detecting manipulation on the brake pedal in a state where a moving speed of the ship hull detected by the detection means is zero.

Advantageous Effects of Invention

An aspect of the present invention can provide a technique enabling a ship to be manipulated as if it was a vehicle.

DESCRIPTION OF EMBODIMENT

Figure 1:
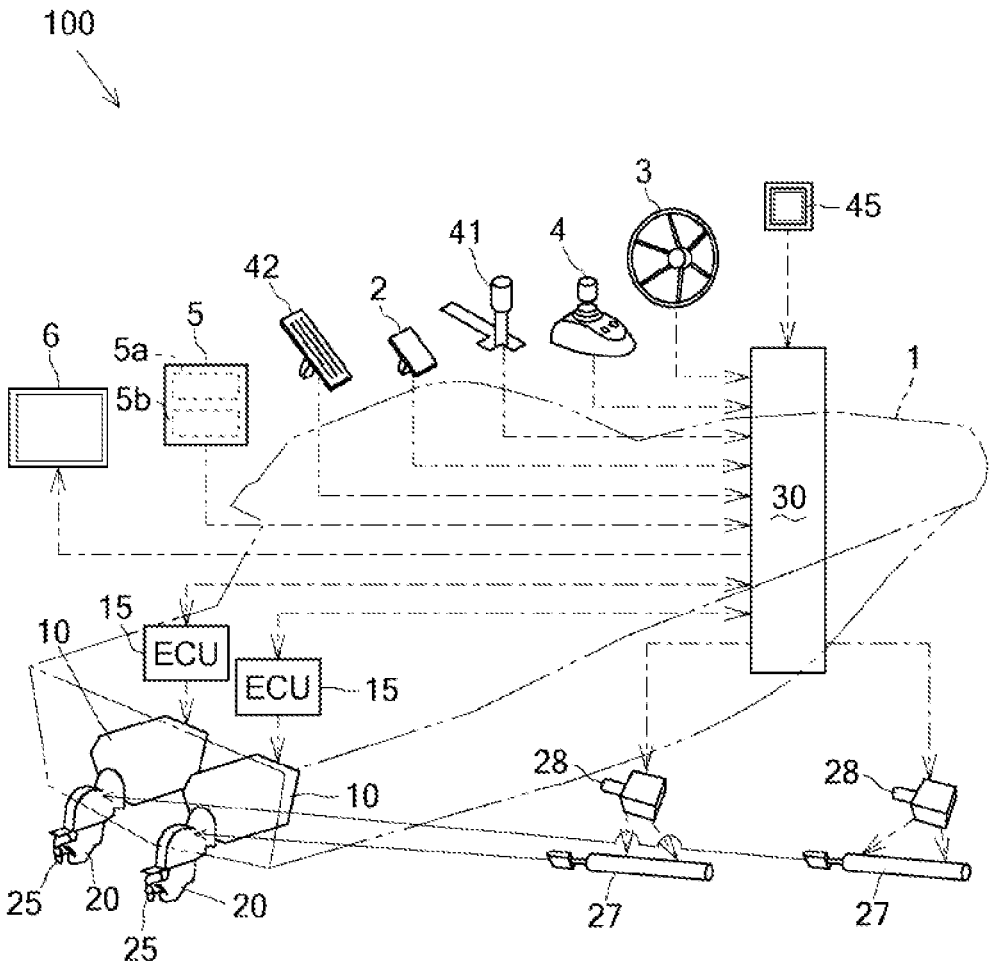
FIG. 1 A diagram showing a basic configuration of a ship.
Figure 2:
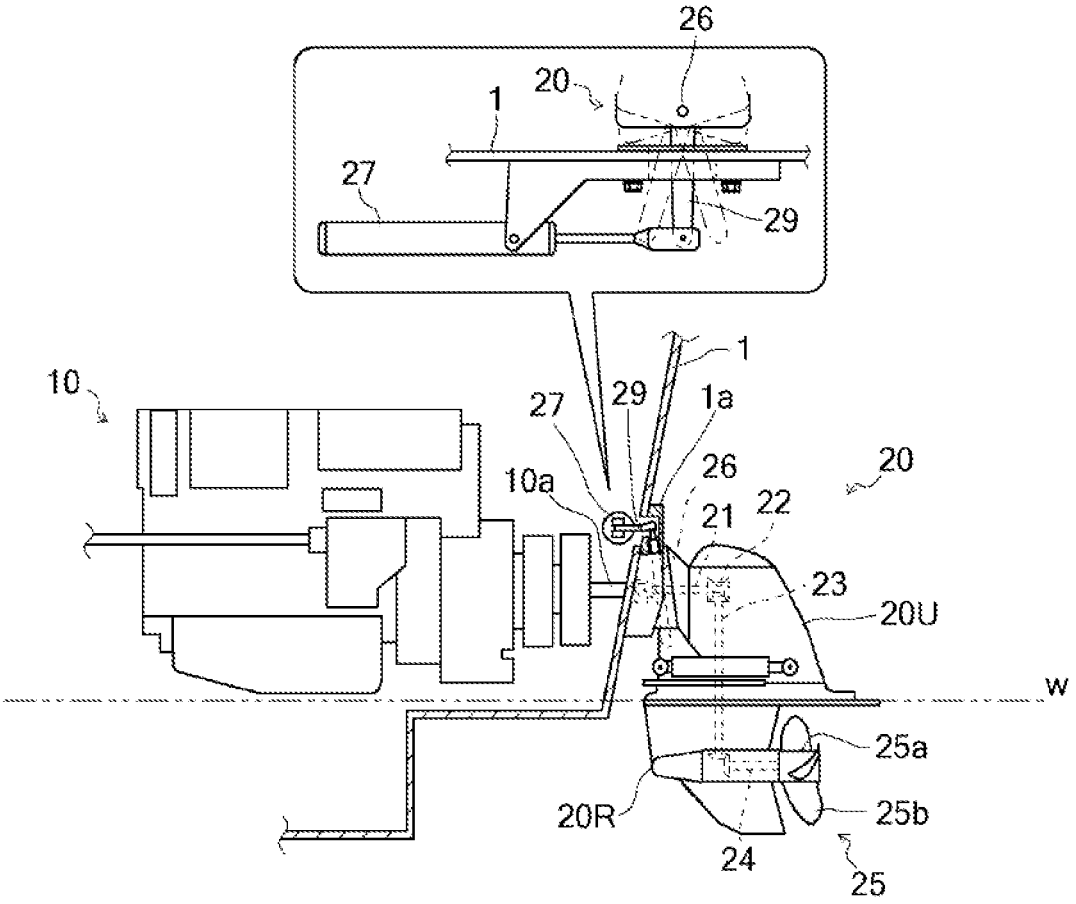
FIG. 2 A diagram showing an engine and an out-drive unit.

A ship 100 will be described with reference to FIG. 1 and FIG. 2. The ship 100 according to this embodiment is a so-called twin propeller ship. The number of propeller shafts is not limited to two, and the ship only needs to include a plurality of shafts.

The ship 100 includes a ship hull 1 including two engines 10 and two out-drive units 20. The out-drive units 20 as propulsion units are driven by the engines 10, and a propulsion force is exerted on the ship hull 1 by rotating propulsive propellers 25 of the out-drive units 20. The ship hull 1 includes an accelerator pedal 2, a steering 3, a joystick lever 4, a shift lever 41, a brake pedal 42, and the like, as manipulation tools for manipulating the ship 100. In accordance with manipulation on these manipulation tools, operating statuses of the engines 10, a propulsion force from the out-drive units 20, and directions in which the propulsion force is exerted are controlled.

In this embodiment, the ship 100 is a stern drive ship including two engines 10 and two out-drive units 20, but is not limited to such a type, and for example, may be a shaft ship including a plurality of propeller shafts, or a ship including a POD type propeller.

By manipulating the steering 3 or the joystick lever 4 of the ship hull 1, output directions of the out-drive units 20 can be changed so that a course of the ship 100 can be changed. The ship hull 1 includes a ship steering control device 30 for performing a ship steering control on the ship 100.

The ship hull 1 includes the steering 3, the joystick lever 4, the shift lever 5, and the brake pedal 42 as manipulation means for controlling the out-drive units 20 for ship steering. The ship hull 1 also includes a global navigation satellite system (GNSS) device 5*a* and a heading sensor 5*b* as detection means 5 for detecting a current position, a bow direction, and a moving speed of the ship hull 1. The GNSS device 5*a* detects the current position and the moving speed of the ship hull 1. The heading sensor 5*b* detects the bow direction of the ship hull 1. The GNSS device 5*a* acquires the current position of the ship hull 1 every predetermined time using a satellite positioning system to thereby detect the moving speed and the moving direction based on a positional shift in addition to the current position of the ship hull 1. A turning speed is detected based on the amount of change in the bow direction detected by the heading sensor 5*b* per a unit time. The ship hull 1 also includes a monitor 6 disposed near the steering 3, for example. The monitor 6 displays a manipulation status of the manipulation tools and a detection result obtained by the detection means 5, and the like.

In this embodiment, the current position, the bow direction, the moving speed, and the like, of the ship hull 1 are detected by the detection means 5 including the GNSS device 5*a* and the heading sensor 5*b*. This, however, is not limitative. For example, a GNSS device for detecting the current position of the ship hull, a gyro sensor for detecting the bow direction of the ship hull, and an electromagnetic log for detecting a sea speed of the ship hull, may be used for separate detections. Alternatively, all of the current position, the bow direction, the moving speed, and the like, may be detected by a GNSS device alone.

An ECU 15, which controls the engine 10, is provided in each of the engines 10. The ECU 15 stores various programs and data for the control on the engine 10. The ECU 15 may be configured with a CPU, a ROM, a RAM, an HDD, and the like, connected by a bus, or may be configured with a one-chip LSI, for example.

The ECU 15 is electrically connected to a fuel metering valve of a fuel supply pump, a fuel injection valve, and various sensors for detecting operating statuses of various devices in the engine 10, though not shown. The ECU 15 controls a feed rate of the fuel metering valve and open/close of the fuel injection valve, and acquires information detected by the various sensors.

Each of the out-drive units 20 rotates a propulsive propeller 25, to cause a propulsion force in the ship hull 1. The out-drive unit 20 includes an input shaft 21, a switching clutch 22, a drive shaft 23, an output shaft 24, and the propulsive propeller 25. In this embodiment, one out-drive unit 20 is cooperatively coupled to one engine 10. Here, the number of out-drive units 20 provided for one engine 10 is not limited to the one described in this embodiment. A drive device is not limited to the out-drive unit 20 of this embodiment. A device whose propeller is directly or indirectly driven by the engine, or a POD type one may be adoptable, too.

The input shaft 21 transmits rotational power of the engine 10 to the switching clutch 22. The input shaft 21 has one end portion thereof coupled to a universal joint attached to an output shaft 10*a* of the engine 10, and the other end portion thereof coupled to the switching clutch 22 disposed inside an upper housing 20U.

The switching clutch 22 is able to switch the rotational power of the engine 10, which has been transmitted through the input shaft 21 and the like, from one to the other between a normal rotation direction and a reverse rotation direction. The switching clutch 22 includes a normal rotation bevel gear coupled to an inner drum having disk plates, and a reverse rotation bevel gear. The switching clutch 22 presses a pressure plate of an outer drum which is coupled to the input shaft 21 against any of the disk plates, to transmit power. The switching clutch 22 brings the pressure plate into a half-clutch state in which the pressure plate is imperfectly pressed against any of the disk plates, to thereby transmit part of the rotational power of the engine 10 to the propulsive propeller 25. The switching clutch 22 brings the pressure plate into a neutral position where the pressure plate is not pressed against any of the disk plates, to thereby disable transmission of the rotational power of the engine 10 to the propulsive propeller 25.

The drive shaft 23 transmits the rotational power of the engine 10, which has been transmitted through the switching clutch 22 and the like, to the output shaft 24. A bevel gear disposed at one end of the drive shaft 23 is meshed with the normal rotation bevel gear and the reverse rotation bevel gear of the switching clutch 22, and a bevel gear disposed at the other end of the drive shaft 23 is meshed with a bevel gear of the output shaft 24 disposed inside a lower housing 20R.

The output shaft 24 transmits the rotational power of the engine 10, which has been transmitted through the drive shaft 23 and the like, to the propulsive propeller 25. The bevel gear disposed at one end of the output shaft 24 is meshed with the bevel gear of the drive shaft 23 as mentioned above, and the other end of the output shaft 24 is provided with the propulsive propeller 25.

Rotation of the propulsive propeller 25 generates a propulsion force. The propulsive propeller 25 is driven by the rotational power of the engine 10 which has been transmitted through the output shaft 24 and the like, and generates a propulsion force by paddling surrounding water with a plurality of blades 25*b* which are arranged around a rotation shaft 25*a*.

Each of the out-drive units 20 is supported by a gimbal housing 1*a* which is attached to a quarter board (transom board) of the ship hull 1. To be specific, each of the out-drive units 20 is supported by the gimbal housing 1*a* in such a manner that a gimbal ring 26 serving as a rotation fulcrum shaft is substantially perpendicular to a waterline w.

An upper portion of the gimbal ring 26 extends to the inside of the gimbal housing 1*a* (ship hull 1), and a steering arm 29 is attached to the upper end of the gimbal ring 26. Rotation of the steering arm 29 causes rotation of the gimbal ring 26, so that the out-drive unit 20 rotates about the gimbal ring 26. The steering arm 29 is driven by a hydraulic actuator 27 that is actuated in conjunction with manipulation on the steering 3 or the joystick lever 4. The hydraulic actuator 27 is controlled by an electromagnetic proportional control valve 28 that switches a flow direction of a working fluid in accordance with manipulation on the steering 3 or the joystick lever 4.

Figure 3:
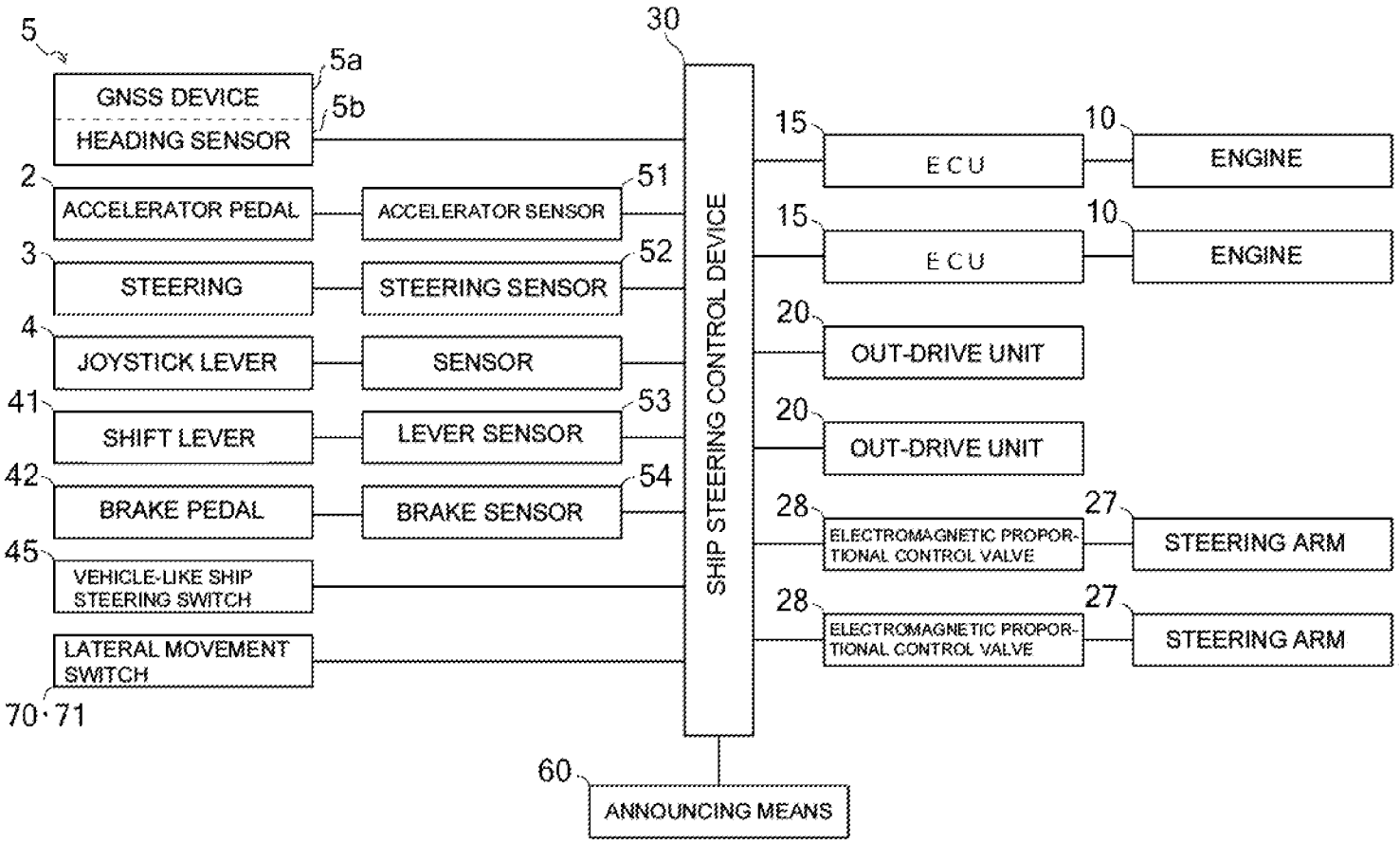
FIG. 3 A block diagram of a ship steering control.

A configuration for a ship steering control that is performed by a ship steering control device will be described with reference to FIG. 3 to FIG. 7. As shown in FIG. 3, the ship steering control device 30 controls the engines 10 and the out-drive units 20 based on detection signals supplied from manipulation tools such as the accelerator pedal 2, the steering 3, the joystick lever 4, the shift lever 41, the brake pedal 42, and the like. The ship steering control device 30 acquires information concerning the current position, the moving speed, the moving direction, the bow direction, and a turning amount of the ship hull 1 from the detection means 5 (the GNSS device 5*a* and the heading sensor 5*b*). Based on detection results obtained by the detection means 5 and manipulation on the manipulation tools, the ship steering control device 30 performs a ship steering control on the ship 100.

The ship steering control device 30 stores various programs and data for controlling the engines 10 and the out-drive units 20. The ship steering control device 30 may be configured with a CPU, a ROM, a RAM, an HDD, and the like, connected by a bus, or may be configured with a one-chip LSI, for example.

The ship steering control device 30, which is connected to the accelerator pedal 2, the steering 3, the joystick lever 4, the shift lever 41, the brake pedal 42, and the like, acquires detection signals that are generated by various sensors when these manipulation tools are manipulated.

More specifically, as shown in FIG. 3, the ship steering control device 30 is electrically connected to: an accelerator sensor 51 for detecting a foot-pushing amount which is a manipulation amount on the accelerator pedal 2; a steering sensor 52 for detecting a rotation angle which is a manipulation amount on the steering 3; a sensor for detecting a manipulation angle, a manipulation amount, and the like, of the joystick lever 4; a lever sensor 53 for detecting a manipulation position of the shift lever 41; and a brake sensor 54 for detecting a foot-pushing amount which is a manipulation amount on the brake pedal 42. The ship steering control device 30 acquires, as manipulation amounts, detection values that are based on detection signals transmitted from these sensors.

The ship steering control device 30, which is electrically connected to the ECUs 15 of the respective engines 10, acquires various detection signals concerning operating statuses of the engines 10 acquired by the ECUs 15. The ship steering control device 30 transmits, to the ECUs 15, signals for turning on and off the engines 10 (ECUs 15) and control signals for controlling the fuel metering valves of the fuel supply pumps and other devices in the engines 10. The ship steering control device 30, which is electrically connected to the electromagnetic proportional control valves 28 of the respective out-drive units 20, controls the electromagnetic proportional control valves 28 based on control signals supplied from the manipulation tools, for steerage.

Figure 4:
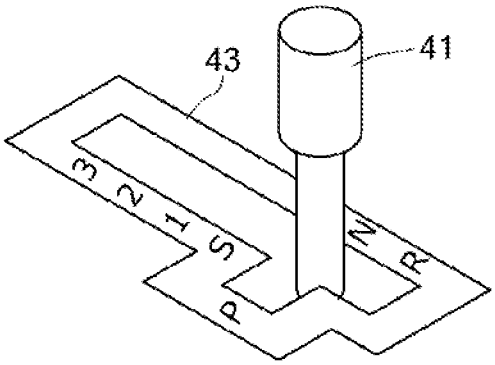
FIG. 4 A diagram showing a configuration of a shift lever.
Figure 4:
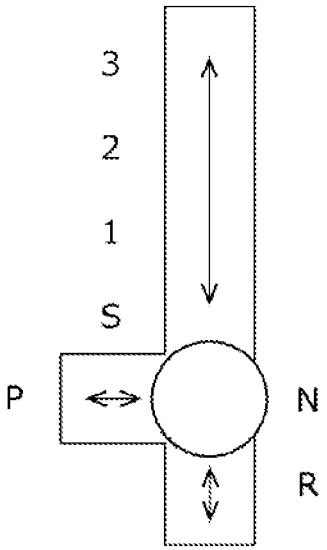

A configuration of the shift lever 41 will now be described with reference to FIG. 4. As shown in FIG. 4, a lever guide 43 for guiding manipulation on the shift lever 41 is disposed around the shift lever 41. In the lever guide 43, forward traveling (S, 1, 2, 3), neutral (N), and reverse traveling (R) are arranged linearly, and positioning (P) is disposed on a lateral side of the neutral (N). The shift lever 41 can be held at each of the positions. The lever sensor 53 detects a shift position at which the shift lever 41 is held. In a range from the neutral (N) position to the forward traveling (S, 1, 2, 3) position and the reverse traveling (R) position, the shift lever 41 is manipulated in one direction along the lever guide 43. In a range from the neutral (N) position to the positioning (P) position, the shift lever 41 is manipulated in a direction orthogonal to the one direction.

The manipulation position of the shift lever 41 of this embodiment includes seven positions in total, namely, the four forward traveling positions, the neutral position, the reverse traveling position, and the positioning position. For the forward traveling, multiple speed positions are provided, each of which is set corresponding to each speed range. Namely, the forward traveling (S) corresponds to trolling (very low speed), the forward traveling (1) corresponds to low speed, the forward traveling (2) corresponds to intermediate speed, and the forward traveling (3) corresponds to high speed. The positions of the shift lever 41 are not limited to the ones illustrated in this embodiment, as long as they include at least four positions of a forward traveling position, a neutral position, a reverse traveling position, and a positioning position. The shape of the lever guide 43 is not limited to the one illustrated in this embodiment. It however is preferable that a manipulation direction toward the positioning position is different from a manipulation direction from the neutral position toward the forward or reverse traveling position.

Manipulating the shift lever 41 into the positioning (P) position causes a dynamic positioning control to be performed. The dynamic positioning control is a control for holding a position of the ship 100 and an azimuth of the bow of the ship hull 1. In the dynamic positioning control, the ECUs 15 of the engines 10 and the out-drive units 20 are controlled such that a propulsion force exerted by the two out-drive units 20 is balanced with an external force such as wind power and tidal power.

To be specific, the lever sensor 53 detects that the manipulation position of the shift lever 41 is at the positioning position. When such a detection result is acquired by the ship steering control device 30, the ship steering control device 30 calculates a target moving amount, a target moving direction, and a target turning amount based on information acquired from the detection means 5, the information concerning the current position, the moving speed, the moving direction, the bow direction, and the turning amount of the ship hull 1. In accordance with a calculation result, the ship steering control device 30 controls an operating status of each engine 10, an output of a propulsion force from each out-drive unit 20, and a direction of the propulsion force. This dynamic positioning control performed by the ship steering control device 30 enables the ship 100 to be automatically held at a set position and a set azimuth.

In the shift lever 41, a maximum number of revolutions of the engine 10 is set in accordance with its manipulation position. As a result, assignment of a foot-pushing amount on the accelerator pedal 2 and an output until reaching a maximum output is controlled such that a maximum output (a maximum moving speed of the ship hull 1) of the out-drive unit 20 can be equal to a maximum output that is set to be exerted when the accelerator pedal 2 is foot-pushed to the maximum. That is, a pseudo gear change is performed by manipulating the shift lever 41, and a speed range that can be outputted by the out-drive unit 20 is set for each manipulation position. An actual output of the out-drive unit 20 (a navigation speed of the ship 100) within the speed range set by the shift lever 41 is operated by the accelerator pedal 2 which will be illustrated below.

The accelerator pedal 2 controls the number of revolutions of the two engines 10. The ship hull 1 is provided with one accelerator pedal 2. A foot-pushing amount on the accelerator pedal 2 is detected by the accelerator sensor 51. The ship steering control device 30 transmits a control signal to the ECU 15 in accordance with the foot-pushing amount on the accelerator pedal 2 thus detected, to change the number of revolutions of the engine 10.

That is, based on a manipulation position of the shift lever 41 and a foot-pushing amount (foot-pushing strength) on the accelerator pedal 2, an output of the out-drive unit 20 is controlled, and a navigation speed of the ship 100 is determined. In a case where the shift lever 41 is manipulated into the low speed forward traveling (S) position so that a low-speed speed range of the forward traveling is set, a foot-pushing amount on the accelerator pedal 2 is assigned as a slip ratio (trolling ratio) in the half-clutch state of the switching clutch 22. Thereby, delicate manipulation within the low-speed speed range is allowed.

As thus described above, in this embodiment, the shift lever 41 including at least four manipulation positions of the forward traveling position, the neutral position, the reverse traveling position, and the positioning position is provided, and the maximum output of the out-drive unit 20 is controlled in accordance with a manipulation position of the shift lever 41. Thereby, the navigation speed of the ship 100 is suppressed. As a result, in the ship 100, a pseudo shift change similar to that of a vehicle can be performed, in which the manipulation position of the shift lever 41 is changed so as to obtain a desired navigation speed of the ship 100. Thus, a ship steering like a vehicle steering can be achieved. Manipulating the shift lever 41 into the positioning position causes the dynamic positioning control to be performed on the ship 100. This provides a pseudo parking control similar to that of a vehicle. Thus, a ship steering (ship stopping manipulation) can be achieved. In addition, an output of the out-drive unit 20 within a speed range set by the shift lever 41 is controlled by manipulation on the accelerator pedal 2. This corresponds rightly to a traveling control operation in a vehicle, and therefore a ship steering like a vehicle steering can be achieved.

To eliminate the need to check a speed every time inside a bay, it may be possible that the GNSS device 5*a* detects a current position and a navigation speed of the ship 100, whether or not it is in a navigation speed restricted area is determined based on the current position of the ship 100, and if it is in the restricted area, the navigation speed is limited so as not to exceed a set speed. This can automatically avoid exceeding the set speed even when the shift lever 41 is manipulated in a speed range including a speed that exceeds a limit speed. It may be also possible to make setting that increases a low-speed side torque by adjusting the assignment of an output of the out-drive unit 20 generated relative to a foot-pushing amount on the accelerator pedal 2 or by changing the output itself of the out-drive unit 20 such as changing a compatible value for controlling a fuel injection amount which is determined depending on an engine load and the number of revolutions of the engine.

The brake pedal 42 limits a moving speed of the ship hull 1 by controlling an output and a direction of the two out-drive units 20. The ship hull 1 is provided with one brake pedal 42. A foot-pushing amount on the brake pedal 42 is detected by the brake sensor 54. In accordance with the foot-pushing amount on the brake pedal 42 thus detected, the ship steering control device 30 changes the number of revolutions of the engine 10, an output of a propulsion force from the out-drive unit 20, and a direction of the propulsion force. That is, by the foot-pushing amount (foot-pushing strength) on the brake pedal 42, the magnitude and direction of the propulsion force from the out-drive unit 20 are controlled, and a navigation speed of the ship 100 is limited.

More specifically, a manipulation amount on the brake pedal 42 is detected by the brake sensor 53, and based on its detection value, the ship steering control device 30 determines an output of a propulsion force from the out-drive unit 20 and a direction in which the propulsion force is exerted, to thereby determine the amount of deceleration of the ship hull 1.

For example, when the brake pedal 42 is kept weakly foot-pushed, the output of the out-drive unit 20 is decreased without changing the output direction, or the output of the out-drive unit 20 is decreased and then the output direction is reversed, so that the ship 100 gradually decelerates, to stop the ship. When the brake pedal 42 is strongly foot-pushed, the output direction of the out-drive unit 20 is reversed so that the speed of the ship 100 rapidly drops, to stop the ship. When the brake pedal 42 is further strongly foot-pushed, an astern operation is performed in which the output direction of the out-drive unit 20 is reversed and the output is increased, to quickly stop the ship 100. A quick stop of the ship can be handled by shortening delay processing which is executed for relieving a shock caused by the astern operation. By keeping the brake pedal 42 foot-pushed, the propulsion force of the out-drive unit 20 is controlled until the moving speed of the ship 100 finally reaches zero. The assignment of the foot-pushing amount on the brake pedal 42 and the propulsion force of the out-drive unit 20 is performed as appropriate. The strength of manipulation on the brake pedal 42 can be identified not only based on a foot-pushing amount on the brake pedal 42 but also based on both an output of the engine 10 and a foot-pushing amount on the brake pedal 42.

When the brake pedal 42 is manipulated to limit the moving speed of the ship hull 1, the GNSS device 5*a* detects the current position and the moving speed of the ship hull 1. The ship steering control device 30, therefore, is configured to perform the dynamic positioning control upon detecting that the brake pedal 42 has been manipulated with the moving speed of the ship hull 1 being zero. That is, if the brake pedal 42 is manipulated while the ship hull 1 is stopped, an output of a propulsion force from the out-drive unit 20 and a direction of the propulsion force are controlled such that the ship 100 stays on the current ship stop position and the current ship stop azimuth.

A specific manipulation on the brake pedal 42 is as follows. To decelerate the ship 100 during navigation, the brake pedal 42 is foot-pushed in accordance with a desired degree of deceleration. Then, to stop the ship, the brake pedal 42 is kept foot-pushed until the moving speed reaches zero. To stop the ship 100 at a predetermined position and hold the ship 100 at this position, firstly the brake pedal 42 is foot-pushed to decelerate the ship hull 1, then the manipulation on the brake pedal 42 is continued until the moving speed reaches zero, and then the brake pedal 42 is further kept foot-pushed while the ship is stopped. Through this manipulation, the dynamic positioning control is performed, so that the ship 100 can be stopped and held at the predetermined position.

As described above, the moving speed of the ship hull 1 can be limited by manipulating the brake pedal 42 provided in the ship hull 1, and further the dynamic positioning can be performed at the ship stop position by manipulating the brake pedal 42 while the ship is stopped. This corresponds rightly to a deceleration or stop operation in a vehicle. Thus, a ship steering like a vehicle steering can be achieved.

The steering 3 changes a direction of the out-drive unit 20, to change a traveling direction of the ship hull 1. A rotation angle which corresponds to a manipulation amount on the steering 3 is detected by the steering sensor 52. Here, unlike a vehicle, the ship 100 has a unique operation called "pivot turn" in which only turning is performed by causing the out-drive units 20 to output in opposite directions. In this embodiment, the turn operating, which is so-called "pivot turn", is performed by manipulating the steering 3.

The ship steering control device 30 permits or prohibits the turning-alone operation with the steering 3, in accordance with a moving speed of the ship hull 1 (a navigation speed of the ship 100) detected by the detection means 5. If the navigation speed of the ship 100 is equal to or less than a predetermined value and the rotation angle detected by the steering sensor 52 is more than a predetermined threshold value (e.g., 360 degrees), the out-drive units 20, 20 are caused to output in opposite directions, to perform turning toward a direction in which the steering 3 is manipulated.

As shown in FIG. 3, announcing means 60 is electrically connected to the ship steering control device 30. The announcing means 60 is provided near the steering 3. The announcing means 60 announces to an operator that turning alone will be performed, by using sound, light, or the like. The announcement is made when the ship steering control device 30 performs a turning operation.

In this manner, the "pivot turn" for turning at the present place is performed only by manipulating the steering 3. Thereby, a ship steering operation like a vehicle steering operation can be achieved, and in addition, operator convenience can be improved. It is conceivable to provide a limit on the navigation speed of the ship 100 as a condition for performing the "pivot turn". This can avoid sudden turning. Since the announcing means 60 makes announcement at a time of performing the "pivot turn", a ship steerability is given to the operator.

As means for achieving ship steering that is more similar to vehicle steering, the following is adoptable. A navigation path through which the ship 100 will navigate is predicted based on a manipulation amount on the steering 3 and a navigation speed of the ship 100. If the distance between a current position of the ship 100 and the predicted navigation path is equal to or more than a certain fixed value, an output of the out-drive unit 20 is calibrated such that the current position of the ship 100 can be along the predicted navigation path. Such calibration makes a steering control less likely to be influenced by tide or wave. Thus, a ship steering that is more similar to a vehicle steering can be achieved.

In another possible control, the "pivot turn" may be performed by manipulating the joystick lever 4. In a case of using the joystick lever 4 for the ship steering, the ship steering operation with the steering 3 is unavailable.

As shown in FIG. 3, a left switch 70 and a right switch 71 for causing lateral movement of the ship hull 1 are connected to the ship steering control device 30. How these lateral movement switches 70, 71 are arranged is not limited. It is preferable that, for example, the lateral movement switches 70, 71 are arranged at a position that is highly convenient for performing lateral movement manipulation, such as a central portion (hub portion) of the steering 3, the monitor 6, or the like. Here, unlike a vehicle, the ship 100 has a unique operation in which, while the out-drive units 20 are caused to output in opposite directions, their outputs are adjusted to direct a synthetic vector resulting from their propulsion forces toward the port side or the starboard side, to thereby cause lateral movement of the ship hull 1. In this embodiment, the lateral movement is performed by operating the lateral movement switches 70, 71.

In another possible control, the "lateral movement" may be performed by manipulating the joystick lever 4. In a case of using the joystick lever 4 for the ship steering, the ship steering operation with the lateral movement switches 70, 71 is unavailable.

As shown in FIG. 3, a vehicle-like ship steering switch 45 for starting/stopping a ship steering operation control enabling the ship 100 to be manipulated as if it was a vehicle is connected to the ship steering control device 30. The vehicle-like ship steering switch 45 is arranged near the steering 3, for example. When the vehicle-like ship steering switch 45 is ON, a vehicle-like ship steering control as described above is performed by the ship steering control device 30. When the vehicle-like ship steering switch 45 is OFF, a normal ship steering control is performed by the ship steering control device 30. The normal ship steering control is a conventional ship steering control, and means that the above-mentioned "pivot turn" with the steering 3 and the ship steering control with the shift lever 41, the accelerator pedal 2, and the brake pedal 42 are partially or entirely unavailable.

Control flows of the vehicle-like ship steering operation in a state where the vehicle-like ship steering switch 45 is ON will now be described with reference to FIG. 5 to FIG. 7.

Figure 5:
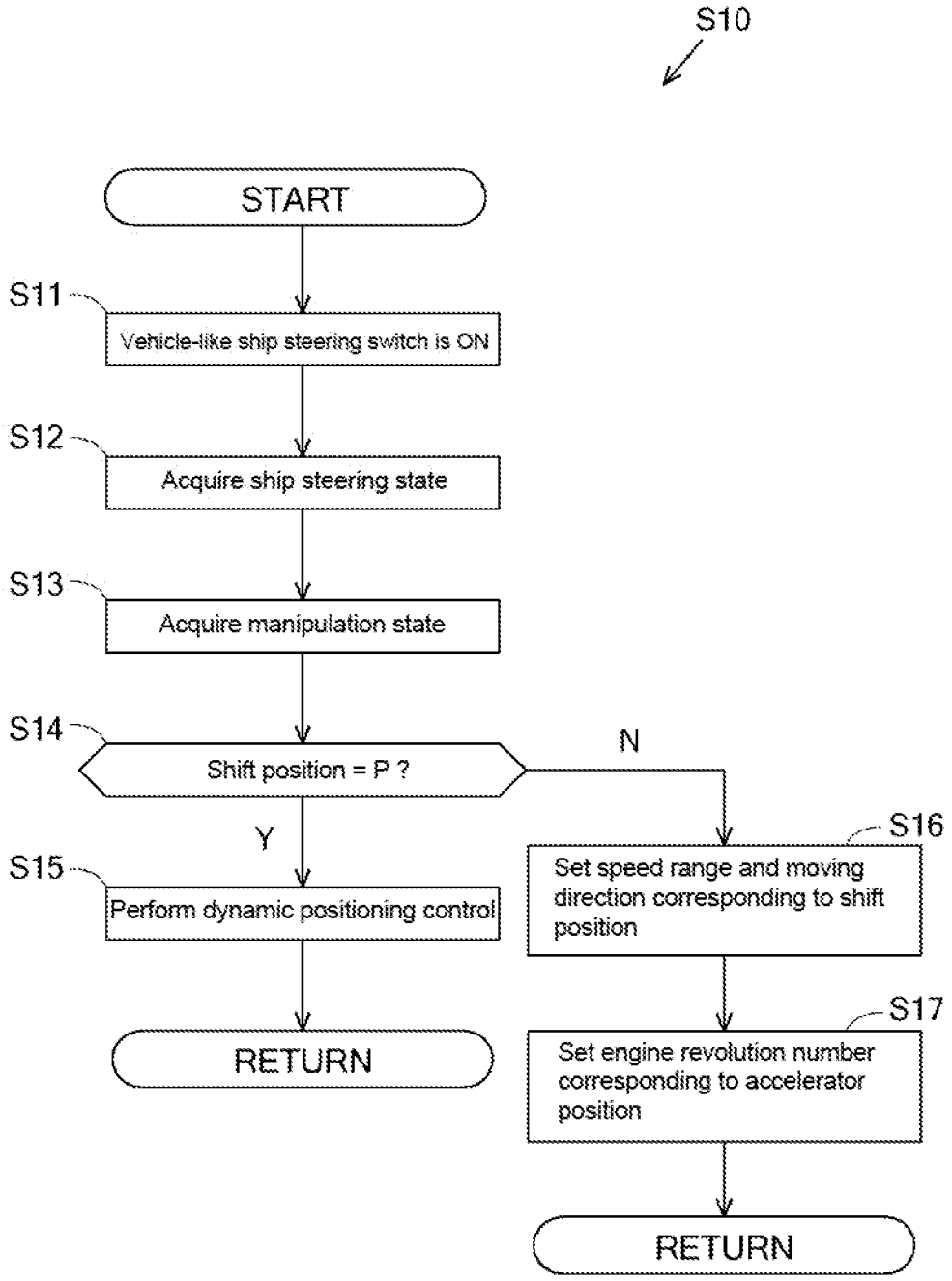
FIG. 5 A flowchart of vehicle-like ship steering.

FIG. 5 shows a control step S10 regarding manipulation on the shift lever and on the accelerator pedal. Firstly in step S11, the fact that the vehicle-like ship steering switch 45 is ON is acquired. In step S12, a ship steering state (information concerning a current position, a moving speed, a moving direction, a bow direction, and a turning amount detected by the detection means) is acquired. In step S13, a manipulation state (information concerning manipulation amounts on the manipulation tools detected by the various sensors) is acquired.

Then, in step S14, whether or not a shift position of the shift lever 41 detected by the lever sensor 53 is the positioning (P) position is determined. If the shift position is P (S14:Y), then in step S15, the dynamic positioning control is performed. If the shift position is not P (S14:N), then in step S16, a speed range and an output direction corresponding to the shift position are set, and then in step S17, the number of revolutions of the engine corresponding to an accelerator position of the accelerator pedal 2 detected by the accelerator sensor 51 is set.

Figure 6:
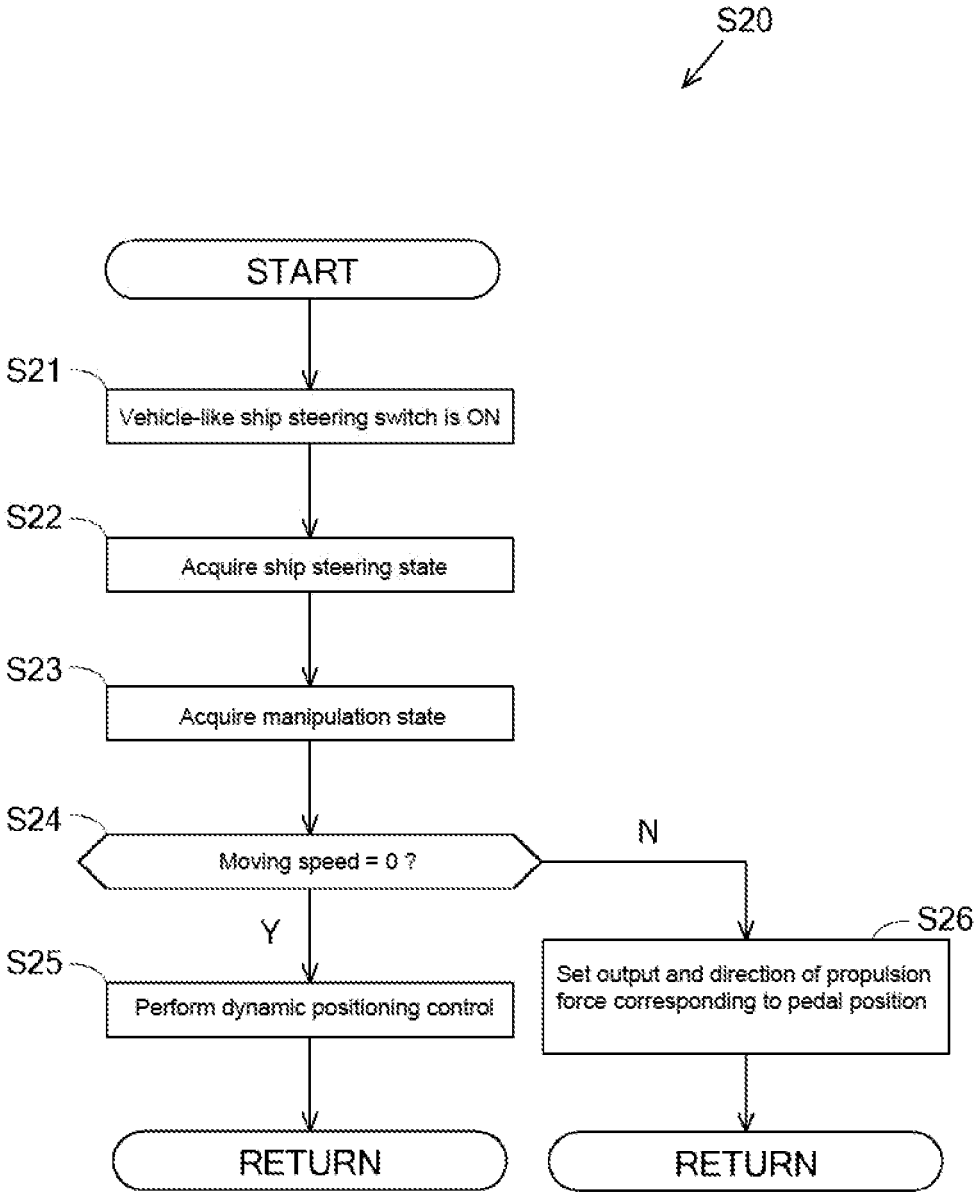
FIG. 6 A flowchart of vehicle-like ship steering.

FIG. 6 shows a control step S20 regarding manipulation on the brake pedal. Firstly in step S21, the fact that the vehicle-like ship steering switch 45 is ON is acquired. In step S22, a ship steering state (information concerning a current position, a moving speed, a moving direction, a bow direction, and a turning amount detected by the detection means 5) is acquired. In step S23, a manipulation state (information concerning manipulation amounts on the manipulation tools detected by the various sensors) is acquired.

Then, in step S24, whether or not a moving speed of the ship hull 1 detected by the detection means 5 is zero is determined. If the moving speed is zero (S24:Y), then in step S25, the dynamic positioning control is performed. If the moving speed is not zero (S24:N), then in step S26, an output and a direction of a propulsion force from the out-drive unit 20 is changed in accordance with a pedal position of the brake pedal 42 detected by the brake sensor 54.

Figure 7:
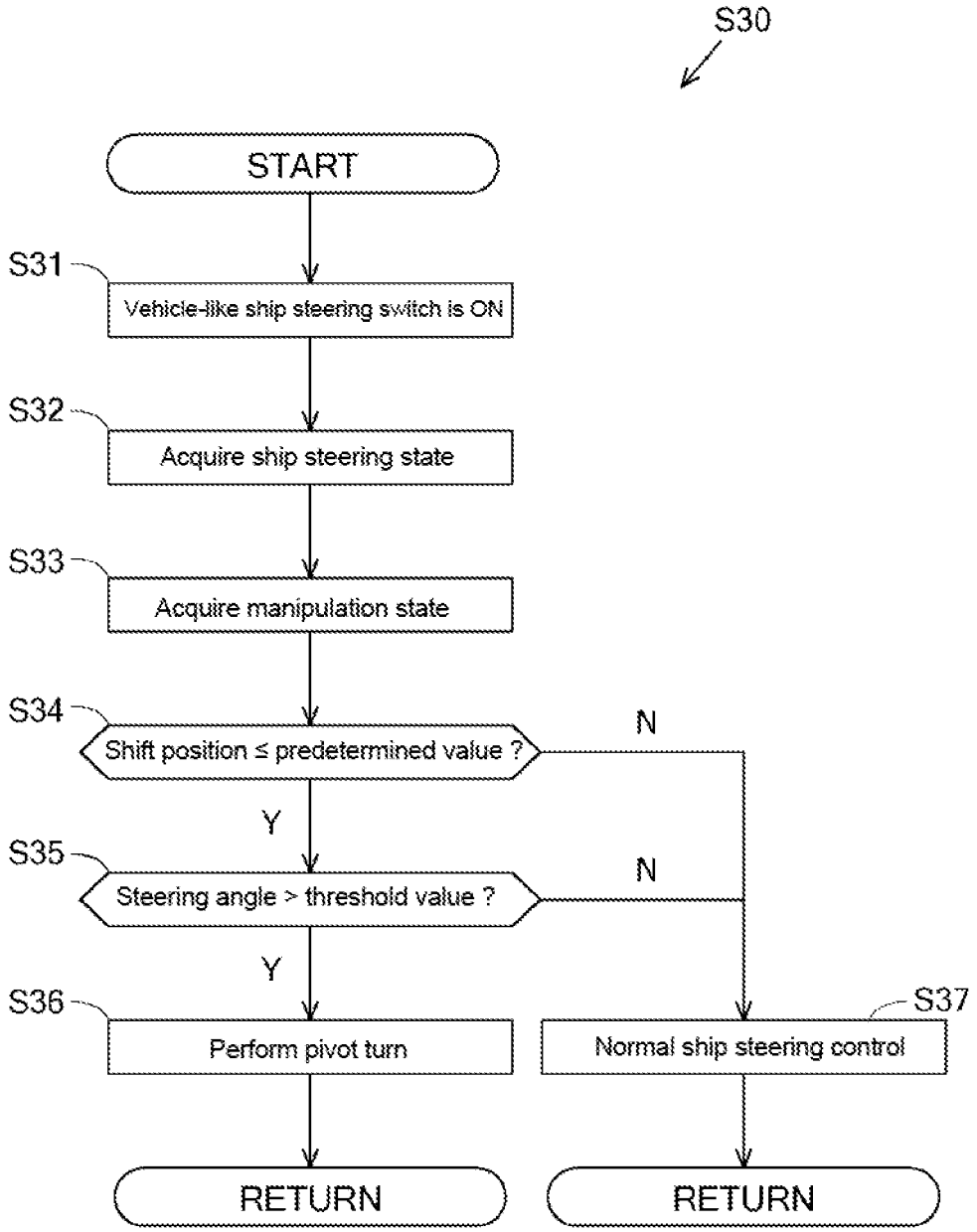
FIG. 7 A flowchart of vehicle-like ship steering.

FIG. 7 shows a control step S30 regarding manipulation on the steering. Firstly, in step S31, the fact that the vehicle-like ship steering switch 45 is ON is acquired. In step S32, a ship steering state (information concerning a current position, a moving speed, a moving direction, a bow direction, and a turning amount detected by the detection means 5) is acquired. In step S33, a manipulation state (information concerning manipulation amounts on the manipulation tools detected by the various sensors) is acquired.

Then, in step S34, whether or not a moving speed of the ship hull 1 detected by the detection means 5 is equal to or less than a predetermined value is determined. If the moving speed is equal to or less than the predetermined value (S34:Y), then in step S35, whether or not a steering angle of the steering 3 detected by the steering sensor 52 is more than a threshold value is determined. If the steering angle is more than the threshold value (S35:Y), then in step S36, the pivot turn is performed. If the moving speed is more than the predetermined value (S34:N) or if the steering angle is equal to or less than the threshold value (S35:N), the processing advances to step S37 to continue the normal ship steering control.

INDUSTRIAL APPLICABILITY

Some aspects of the present invention are applicable to ships.

REFERENCE SIGNS LIST

1: ship hull, 2: accelerator pedal, 3: steering, 5: detection means, 5*a*: GNSS device, 5*b*: heading sensor, 10: engine, 20:

out-drive unit, 30: ship steering control device, 41: shift lever, 42: brake pedal, 45: vehicle-like ship steering switch, 51: accelerator sensor, 52: steering sensor, 53: lever sensor, 54: brake sensor

The invention claimed is:

1. A ship comprising:

a propulsion unit configured to exert a propulsion force on a ship hull by power from an engine;

detection means configured to detect a current position, a bow direction, and a moving speed of the ship hull;

a brake pedal configured to limit a moving speed of the ship hull;

a brake sensor configured to detect a foot-pushing amount on the brake pedal; and a control device connected to the propulsion unit, the detection means, and the brake sensor, the control device configured to:

acquire an operating status of the propulsion unit and detection results obtained by the detection means and the brake sensor;

control the propulsion unit based on the detection results;

change an output of the propulsion unit in accordance with a foot-pushing amount on the brake pedal detected by the brake sensor; and while the moving speed is greater than zero;

based on a determination that the foot-pushing amount is greater than or equal to a predetermined value, reverse an output direction of the propulsion unit; and while the moving speed is equal to zero:

based on detection, by the brake sensor, of any foot-pushing amount on the brake pedal, perform a dynamic positioning control in which the ship is automatically held at a set position.

2. The ship according to claim 1, wherein, during the dynamic positioning control, the control device is configured to:

set the current position as the set position; and operate the propulsion unit so that the ship hull stays at the set position.

3. The ship according to claim 2, wherein, during the dynamic positioning control, the control device is configured to:

set the bow direction as a current ship stop azimuth; and operate the propulsion unit so that the ship hull stays at the current ship stop azimuth.

4. The ship according to claim 1, further comprising an accelerator pedal that is separate from the brake pedal, the accelerator pedal configured to increase the moving speed of the ship hull.

5. The ship according to claim 1, wherein the control device is further configured to:

based on manipulation on the brake pedal, determine the foot-pushing amount on the brake pedal;

perform a comparison based on the foot-pushing amount and the predetermined value; and change the output of the propulsion unit based on the comparison.

6. The ship according to claim 1, wherein the control device is further configured to decrease the output of the propulsion unit based on a determination that the foot-pushing amount is less than the predetermined value while the moving speed is greater than zero.

7. The ship according to claim 1, further comprising a vehicle-like ship steering switch configured to operate the ship between:

a vehicle-like ship steering control mode in which the foot-pushing amount on the brake pedal detected by the brake sensor changes the output of the propulsion unit; and a normal ship steering control in which the foot-pushing amount on the brake pedal detected by the brake sensor does not change the output of the propulsion unit.

8. A ship comprising:

an engine control unit (ECU) configured to control a propeller of a ship, the ECU further configured to:

determine a moving speed of a ship;

receive an input from a brake sensor corresponding to a depression amount of a brake pedal; and wherein based on receiving the input from the brake sensor while the moving speed of the ship is zero, the ECU is configured to perform a dynamic positioning control in which the ship is automatically held at a set position; and wherein based on receiving the input from the brake sensor while the moving speed of the ship is greater than zero, the ECU is configured to:

compare the depression amount to a predetermined value; and based on the depression amount being less than the predetermined value, reduce a rotation speed of the propeller; and based on the depression amount being greater than the predetermined value, reverse a rotation direction of the propeller.

9. The ship of claim 8, further comprising:

a drive unit including:

an engine;

an drive shaft coupled to the engine; and the propeller configured to propel the ship based on rotation of the drive shaft.

10. The ship of claim 9, wherein the ECU is further configured to determine a current position of the ship.

11. The ship of claim 10, wherein, during the dynamic positioning control, the ECU is further configured to:

set the current position as the set position; and operate the propeller so that the ship stays at the set position.

12. The ship of claim 9, wherein the ECU is further configured to determine a bow direction of the ship.

13. The ship of claim 12, wherein, during the dynamic positioning control, the ECU is further configured to:

set the bow direction as a current ship stop azimuth; and operate the propeller so that the ship stays at the current ship stop azimuth.

14. The ship of claim 9, wherein, based on actuation of an accelerator pedal, the ECU is further configured to increase a rotation speed of the propeller to increase the moving speed of the ship.

15. The ship of claim 14, wherein the brake pedal distinct from the accelerator pedal.

16. The ship of claim 9, wherein:

the propeller includes an output shaft and a plurality of blades coupled to the output shaft; and the rotation direction of the propeller rotates about a central axis of the output shaft.

17. A computer readable storage device comprising instructions, that when executed by a processor, cause the processor to:

based on receipt of a first indication of a first depression amount of a brake pedal while a speed of a ship is less than a first threshold, transmit a first signal to one or more propellers to perform a dynamic positioning control in which the ship is automatically held at a set position; and based on receipt of a second indication of a second depression amount of the brake pedal while the speed of the ship is greater than the first threshold:

compare the second depression amount to a second threshold;

based on the second depression amount being less than the second threshold, transmit a second signal to the one or more propellers to change an output of the one or more propellers to decrease the speed of the ship; and based on the second depression amount being greater than the second threshold, transmit a third signal to the one or more propellers to reverse an output direction of the one or more propellers to decrease the speed of the ship.

18. The computer readable storage device of claim 17, wherein, the instructions, when executed by the processor, further cause the processor to:

receive, from an accelerator sensor, an actuation amount of an accelerator pedal; and based on receiving the actuation amount, transmit a fourth signal to the one or more propellers to increase an output of the one or more propellers to increase the speed of the ship.

* * * * *